US007142175B2

(12) United States Patent
Kang

(10) Patent No.: US 7,142,175 B2
(45) Date of Patent: Nov. 28, 2006

(54) METHOD AND APPARATUS FOR DISPLAYING GRAYSCALE OF PLASMA DISPLAY PANEL

(75) Inventor: Kyoung-Ho Kang, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 526 days.

(21) Appl. No.: 10/771,061

(22) Filed: Feb. 4, 2004

(65) Prior Publication Data

US 2004/0155891 A1 Aug. 12, 2004

(30) Foreign Application Priority Data

Feb. 8, 2003 (KR) ..... 10-2003-0007995

(51) Int. Cl.
*G09G 3/28* (2006.01)

(52) U.S. Cl. ..... 345/63; 345/690

(58) Field of Classification Search ..... 345/60, 345/63, 690

See application file for complete search history.

(56) References Cited

U.S. PATENT DOCUMENTS

| | | | | |
|---|---|---|---|---|
| 5,541,618 | A | 7/1996 | Shinoda | 345/60 |
| 6,331,843 | B1 * | 12/2001 | Kasahara et al. | 345/63 |
| 6,429,833 | B1 | 8/2002 | Ryeom et al. | 345/63 |
| 6,897,836 | B1 * | 5/2005 | Tokunaga | 345/63 |
| 2003/0169217 | A1 * | 9/2003 | Kang et al. | 345/63 |

* cited by examiner

*Primary Examiner*—Jimmy H. Nguyen
(74) *Attorney, Agent, or Firm*—H.C. Park & Associates, PLC

(57) ABSTRACT

A method and apparatus for displaying a grayscale of a plasma display panel are provided. In the method, an externally input image signal is divided into frames and each frame is divided into a plurality of subfields allocated a predetermined brightness value. The method includes detecting a frequency of each grayscale, which indicates the number of cells to be displayed for each grayscale in a frame, comparing the frequency of each grayscale with a predetermined reference value, and adjusting at least one among the number of grayscales in the frame and the number of subfields in the frame according to the result of the comparison to set subfields in the frame.

22 Claims, 15 Drawing Sheets

METHOD AND APPARATUS FOR DISPLAYING GRAYSCALE OF PLASMA DISPLAY PANEL

BACKGROUND OF THE INVENTION

This application claims the priority of Korean Patent Application No. 2003-7995, filed on Feb. 8, 2003, in the Korean Intellectual Property Office, the disclosure of which is incorporated herein in its entirety by reference.

FIELD OF THE INVENTION

The invention relates to a method and apparatus for displaying a grayscale on a plasma display panel, and more particularly, to a method and apparatus for displaying a grayscale of a plasma display panel, by which an image is optimally displayed according to characteristics of the image.

DESCRIPTION OF THE RELATED ART

FIG. 1 shows the structure of a surface discharge type triode plasma display panel. FIG. 2 shows an example of a discharge cell of the plasma display panel shown in FIG. 1. Referring to FIGS. 1 and 2, address electrode lines $A_{R1}$, $A_{R2}$, . . . , $A_{Gm}$, $A_{Bm}$, dielectric layers 11 and 15, Y-electrode lines $Y_1$, . . . , $Y_n$, X-electrode lines $X_1$, . . . , $X_n$, phosphor layers 16, partition walls 17, and a magnesium oxide (MgO) layer 12 as a protective layer are provided between front and rear glass substrates 10 and 13 of a general surface discharge plasma display panel 1.

The address electrode lines $A_{R1}$ through $A_{Bm}$ are formed on the front surface of the rear glass substrate 13 in a predetermined pattern. A rear dielectric layer 15 is formed on the entire surface of the rear glass substrate 13 having the address electrode lines $A_{R1}$ through $A_{Bm}$. The partition walls 17 are formed on the front surface of the rear dielectric layer 15 to be parallel to the address electrode lines $A_1$ through $A_m$. These partition walls 17 define the discharge areas of respective discharge cells and serve to prevent cross talk between discharge cells. The phosphor layers 16 are formed between partition walls 17.

The X-electrode lines $X_1$ through $X_n$ and the Y-electrode lines $Y_1$ through $Y_n$ are formed on the rear surface of the front glass substrate 10 in a predetermined pattern to be substantially orthogonal to the address electrode lines $A_{R1}$ through $A_{Bm}$. The respective intersections define discharge cells. Each of the X-electrode lines $X_1$ through $X_n$ is composed of a transparent electrode line $X_{na}$ (FIG. 2) formed of a transparent conductive material, e.g., indium tin oxide (ITO), and a metal electrode line $X_{nb}$ (FIG. 2) for increasing conductivity. Each of the Y-electrode lines $Y_1$ through $Y_n$ is composed of a transparent electrode line $Y_{na}$ (FIG. 2) formed of a transparent conductive material, e.g., ITO, and a metal electrode line $Y_{nb}$ (FIG. 2) for increasing conductivity. A front dielectric layer 11 is deposited on the entire rear surface of the front glass substrate 10 having the rear surfaces of the X-electrode lines $X_1$ through $X_n$ and the Y-electrode lines $Y_1$ through $Y_n$. The protective layer 12, e.g., a MgO layer, for protecting the panel 1 against a strong electrical field is deposited on the entire surface of the front dielectric layer 11. A gas for forming plasma is hermetically sealed in a discharge space 14.

An address-display separation driving method for the plasma display panel 1 having such a structure is disclosed in U.S. Pat. No. 5,541,618.

FIG. 3 shows a typical address-display separation driving method with respect to Y-electrode lines of the plasma display panel 1 shown in FIG. 1. Referring to FIG. 3, to realize time-division grayscale display, a unit frame is divided into 8 subfields SF1 through SF8. In addition, the individual subfields SF1 through SF8 are composed of reset periods (not shown), address periods A1 through A8, respectively, and sustain periods S1 through S8, respectively.

During each of the address periods A1 through A8, display data signals are applied to the address electrode lines $A_{R1}$ through $A_{Bm}$ of FIG. 1, and simultaneously, a scan pulse is sequentially applied to the Y-electrode lines $Y_1$ through $Y_n$.

During each of the sustain periods S1 through S8, a sustain pulse is alternately applied to the Y-electrode lines $Y_1$ through $Y_n$ and the X-electrode lines $X_1$ through $X_n$, thereby provoking display discharge in discharge cells in which wall charges are induced during each of the address periods A1 through A8. Accordingly, the brightness of a plasma display panel is proportional to a total length of the sustain periods S1 through S8 in a unit frame. The total length of the sustain periods S1 through S8 in a unit frame is 255 T (T is a unit time). Here, the sustain period Sn of an n-th subfield SFn is set to a time corresponding to $2^{n-1}$. Accordingly, if a subfield to be displayed is appropriately selected from among 8 subfields, a total of 256 grayscales including a gray level of zero at which display is not performed in any subfield can be displayed.

According to the above-described address-display separation driving method, the time domains of the respective subfields SF1 through SF8 are separated, so the time domains of respective address periods of the subfields SF1 through SF8 are separated, and the time domains of respective sustain periods of the subfields SF1 through SF8 are separated. Accordingly, during an address period, an XY-electrode line pair is kept waiting after being addressed until all of the other XY-electrode line pairs are addressed. Consequently, in each subfield, an address period increases, and a sustain period decreases. As a result, the brightness of light emitted from a plasma display panel decreases. A method proposed for overcoming this problem is an address-while-display driving method, as shown in FIG. 4.

FIG. 4 shows a typical address-while-display driving method with respect to the Y-electrode lines of the plasma display panel 1 shown in FIG. 1. Referring to FIG. 4, to realize time-division grayscale display, a unit frame is divided into 8 subfields $SF_1$ through $SF_8$. Here, the subfields-$SF_1$ through $SF_8$ overlap with respect to the Y-electrode lines $Y_1$ through $Y_n$ and constitute a unit frame. Since all of the subfields $SF_1$ through $SF_8$ exist at any time point, address time slots are set among sustain pulses in order to perform each address step.

In each of the subfields $SF_1$ through $SF_8$, a reset step, address step, and display discharge step are performed. A time allocated to each of the subfields $SF_1$ through $SF_8$ depends on a display discharge time corresponding to a grayscale. For example, when displaying 256 grayscales with 8-bit video data in units of frames, if a unit frame (usually, 1/60 second) is composed of 256 unit times, an n-th subfield $SF_n$ driven according to video data of the least significant bit has a time corresponding to $2^{n-1}$. Since the sum of unit times allocated to the subfields $SF_1$ through $SF_8$ is 255, 255 grayscale display can be accomplished. If a grayscale having no display discharge in any subfield is included, 256 grayscale display can be accomplished.

FIG. 5 shows a typical driving apparatus for the plasma display panel shown in FIG. 1. Referring to FIG. 5, the typical driving apparatus for the plasma display panel 1 includes a video processor 66, a logic controller 62, an address driver 63, an X-driver 64, and a Y-driver 65. The video processor 66 converts an external analog video signal into a digital signal to generate an internal video signal composed of, for example, 8-bit red (R) video data, 8-bit green (G) video data, 8-bit blue (B) video data, a clock signal, a horizontal synchronizing signal, and a vertical synchronizing signal. The logic controller 62 generates drive control signals $S_A$, $S_Y$, and $S_X$ in response to the internal video signal from the video processor 66. The address driver 63 processes the address signal SA among the drive control signals $S_A$, $S_Y$, and $S_X$ output from the logic controller 62 to generate a display data signal and applies the display data signal to address electrode lines. The X-driver processes the X-drive control signal $S_X$ among the drive control signals $S_A$, $S_Y$, and $S_X$ output from the logic controller 62 and applies the result of processing to X-electrode lines. The Y-driver processes the Y-drive control signal $S_Y$ among the drive control signals $S_A$, $S_Y$, and $S_X$ output from the logic controller 62 and applies the result of processing to Y-electrode lines.

FIG. 6 shows driving signals applied to the plasma display panel 1 shown in FIG. 1 in a unit subfield according to the address-display separation driving method shown in FIG. 3. In FIG. 6, a reference character $S_{AR1 \ldots ABm}$ denotes a driving signal applied to the address electrode lines $A_{R1}$ through $A_{Bm}$ of FIG. 1. A reference character $S_{X1 \ldots Xn}$ denotes a driving signal applied to the X-electrode lines $X_1$ through $X_n$ of FIG. 1. Reference characters $S_{Y1}$ through $S_{Yn}$ denote driving signals, respectively, applied to the respective Y-electrode lines $Y_1$ through $Y_n$ of FIG. 1. FIG. 7 shows a distribution of wall charges in a discharge cell immediately after a gradually increasing voltage is applied to the Y-electrode lines $Y_1$ through $Y_n$ during a reset period PR of FIG. 6. FIG. 8 shows a distribution of wall charges in a discharge cell at an end point of the reset period PR. In FIGS. 2, 7, and 8, the same reference numerals denote an element having the same function.

Referring to FIG. 6, initially during the reset period PR of a unit subfield SF, a voltage applied to the X-electrode lines $X_1$ through $X_n$ is continuously increased from a ground voltage $V_G$ to a second voltage $V_S$, for example, 155 V. During that time, a ground voltage $V_G$ is applied to the Y-electrode lines $Y_1$ through $Y_n$ and the address electrode lines $A_{R1}$ through $A_{Bm}$. As a result, low discharge occurs between the X-electrode lines $X_1$ through $X_n$ and the Y-electrode lines $Y_1$ through $Y_n$ and between the X-electrode lines $X_1$ through $X_n$ and the address electrode lines $A_{R1}$ through $A_{Bm}$, so that negative wall charges are formed around the X-electrode lines $X_1$ through $X_n$.

Then, the voltage applied to the Y-electrode lines $Y_1$ through $Y_n$ is continuously increased from the second voltage $V_S$, for example, 155 V, to a maximum voltage $V_{SET}+V_S$, for example, 355 V, which is higher than the second voltage $V_S$ by a third voltage $V_{SET}$. During that time, the ground voltage $V_G$ is applied to the X-electrode lines $X_1$ through $X_n$ and the address electrode lines $A_{R1}$ through $A_{Bm}$. As a result, low discharge occurs between the Y-electrode lines $Y_1$ through $Y_n$ and the X-electrode lines $X_1$ through $X_n$, and lower discharge occurs between the Y-electrode lines $Y_1$ through $Y_n$ and the address electrode lines $A_{R1}$ through $A_{Bm}$. The discharge between the Y-electrode lines $Y_1$ through $Y_n$ and the X-electrode lines $X_1$ through $X_n$ is higher than the discharge between the Y-electrode lines $Y_1$ through $Y_n$ and the address electrode lines $A_{R1}$ through $A_{Bm}$ because negative wall charges have been formed around the X-electrode lines $X_1$ through $X_n$. As a result, a large amount of negative wall charges are formed around the Y-electrode lines $Y_1$ through $Y_n$ positive wall charges are formed around the X-electrode lines $X_1$ through $X_n$, and a small amount of positive wall charges are formed around the address electrode lines $A_{R1}$ through $A_{Bm}$, as shown in FIG. 7.

Next, the voltage applied to the Y-electrode lines $Y_1$ through $Y_n$ is continuously decreased from the second voltage $V_S$ to the ground voltage $V_G$ while the voltage applied to the X-electrode lines $X_1$ through $X_n$ is maintained at the second voltage $V_s$. During this time, the ground voltage $V_G$ is applied to the address electrode lines $A_{R1}$ through $A_{Bm}$. As a result, some of the negative wall charges around the Y-electrode lines $Y_1$ through $Y_n$ move to the X-electrode lines $X_1$ through $X_n$, as shown in FIG. 8, due to low discharge between the X-electrode lines $X_1$ through $X_n$ and the Y-electrode lines $Y_1$ through $Y_n$. In addition, since the ground voltage $V_G$ is applied to the address electrode lines $A_{R1}$ through $A_{Bm}$, a slight amount of positive wall charges are additionally formed around the address electrode lines $A_{R1}$ through $A_{Bm}$.

Accordingly, during a subsequent address period PA, display data signals are applied to the address electrode lines $A_{R1}$ through $A_{Bm}$, and a scan signal having the ground voltage $V_G$ is sequentially applied to the Y-electrode lines $Y_1$ through $Y_n$ biased to a fourth voltage $V_{SCAN}$ lower than the second voltage $V_S$, so that addressing can be smoothly performed. Here, display data signals for selecting a discharge cell have a positive address voltage $V_A$, and the others have the ground voltage $V_G$. Accordingly, when a display data signal having the positive address voltage $V_A$ is applied while a scan pulse having the ground voltage $V_G$ is being applied, wall charges are induced by address discharge in a corresponding discharge cell. However, wall charges are not formed in other discharge cells. Here, to accomplish more accurate and efficient address discharge, the second voltage $V_S$ is applied to the X-electrode lines $X_1$ through $X_n$.

During a subsequent sustain period PS, a sustain pulse having the second voltage $V_S$ is alternately applied to the Y-electrode lines $Y_1$ through $Y_n$ and the X-electrode lines $X_1$ through $X_n$, thereby provoking display discharge in discharge cells in which wall charges are induced during the address period PA.

U.S. Pat. No. 6,429,833, entitled "Method and Apparatus for Displaying Grayscale of PDP", discloses a method for displaying a grayscale of a plasma display panel, by which generation of a pseudo contour is prevented. It will be assumed that the content disclosed in the U.S. Pat. No. 6,429,833 is included in this specification, and thus a detailed description thereof will be omitted.

Pseudo-contour noise may occur, when a motion picture is displayed on a typical plasma display panel displaying a grayscale by combining subfields. When pseudo-contour noise occurs, dark or bright lines appear on the motion picture, which degrades the display quality of the plasma display panel.

To remove pseudo-contour noise from a motion picture, a method of dividing a subfield to increase the number of subfields, a method of rearranging a sequence of subfields, a method of increasing the number of subfields and rearranging a sequence of subfields, an error diffusion method, etc., have been proposed.

Since a typical plasma display panel has high consumption power due to its driving characteristics, plasma display panels need to perform automatic power control (APC) according to a load ratio or an average signal level (ASL). The load ratio is a ratio of the number of discharge cells to be displayed due to sustain discharge to a total number of discharge cells (or display cells). The ASL is obtained by dividing a brightness value by a total number of discharge cells. To perform automatic power control (APC), the load ratio or the ASL is predicted with respect to each frame, and the number of sustain pulses corresponding to the load ratio or the ASL in a frame is controlled.

FIG. 9 is a graph showing a principle of APC according to an ASL in a typical plasma display panel. In FIG. 9, only four steps are shown for clarity of description, but a large number of steps can be expressed in a look-up table (LUT) when needed.

Referring to FIG. 9, the maximum number of sustain pulses, N4, is applied to the ASL ranging from a minimum of 0 to L1. The number of sustain pulses, N3, is applied to the ASL ranging from L1 to L2. The number of sustain pulses, N2, is applied to the ASL ranging from L2 to L3. The minimum number of sustain pulses, N1, is applied to the ASL higher than L3.

FIG. 10 schematically illustrates a typical method of displaying a grayscale of a plasma display panel using APC according to an ASL. In FIG. 10, the APC includes only three steps I, II, and III for clarity of the description. However, actually, the APC includes a lot of steps, for example, 128 or 256 steps. In step I, the ASL of an externally input image signal is low, and an image is entirely dark. Conversely, in step III, the ASL is high, and the image is entirely bright, so power consumption is large. In order to reduce power consumption, the sustain period PS is reduced to decrease the entire discharge time.

Since the ASL is obtained by dividing a brightness value of an input image signal by a total number of discharge cells, it is useful information in analyzing the whole state of an image for APC. However, using the ASL is limited in optimally displaying an image, for example, delicately displaying a grayscale or properly expressing contrast and brightness.

SUMMARY OF THE INVENTION

The invention provides a method and apparatus for displaying a grayscale of a plasma display panel, by which frequency of each grayscale in an image to be displayed is detected and at least one among the number of grayscales to be displayed and the number of subfields is adjusted according to the frequency of each grayscale to smoothly display low grayscales or increase brightness, thereby displaying an optimal image corresponding with visibility.

According to an aspect of the invention, there is provided a method of displaying a grayscale of a plasma display panel, by which an externally input image signal is divided into frames and each frame is divided into a plurality of subfields allocated a predetermined brightness value. The method includes (a) detecting frequency of each grayscale, which indicates the number of cells to be displayed for each grayscale in a frame; (b) comparing the frequency of each grayscale with a predetermined reference value; and (c) adjusting at least one among the number of grayscales in the frame and the number of subfields in the frame according to the result of the comparison to set subfields in the frame.

In various embodiments of the invention, step (c) may include enhancing low grayscale display by increasing at least one among the number of grayscales in the frame and the number of subfields in the frame and enhancing contrast by decreasing the number of subfields in the frame.

In various embodiments of the invention, step (a) may include detecting a detection frequency which is the sum of frequencies of grayscales higher than a predetermined reference grayscale, and the low grayscale display is enhanced in step (c) when the detection frequency is less than the predetermined reference value. When the detection frequency is equal to or greater than the predetermined reference value, the contrast is enhanced in step (c). When 256 grayscales are displayed in each frame, the predetermined reference grayscale may be 250.

According to another aspect of the invention, there is provided a method of displaying a grayscale of a plasma display panel, by which an externally input image signal is divided into frames and each frame is divided into a plurality of subfields allocated a predetermined brightness value. The method includes (a) detecting an average signal level of the image signal in a frame; (b) comparing the detected average signal level with a predetermined reference level; (c) detecting frequency of each grayscale which indicates the number of cells to be displayed for each grayscale in the frame; (d) comparing the frequency of each grayscale with a predetermined reference value; and (e) adjusting at least one among the number of grayscales in the frame and the number of subfields in the frame according to the result of comparing the average signal level and the result of comparing the sum of the frequencies to set subfields in the frame.

In various embodiments of the invention, the method may further include adjusting a discharge time to be in inverse proportion to the average signal level.

In various embodiments of the invention, step (e) may include enhancing low grayscale display by increasing at least one among the number of grayscales in the frame and the number of subfields in the frame, enhancing contrast by decreasing the number of subfields in the frame, alleviating a pseudo-contour by decreasing the number of grayscales in the frame, and setting a default mode by setting the number of grayscales in the frame and the number of subfields in the frame to predetermined default values, respectively.

When the average signal level is higher than a first predetermined reference level, the pseudo-contour is alleviated in step (e). When the average signal level is lower than the first predetermined reference level and higher than a second predetermined reference level, the default mode is set in step (e). When the average signal level is lower than the second predetermined reference level, step (c) is performed.

In various embodiments of the invention, step (c) may include detecting a detection frequency which is the sum of frequencies of grayscales higher than a predetermined reference grayscale, and the low grayscale display is enhanced in step (e) when the detection frequency is less than the predetermined reference value. When the detection frequency is equal to or greater than the predetermined reference value, the contrast is enhanced in step (e). When 256 grayscales are displayed in each frame, the predetermined reference grayscale is 250.

According to still another aspect of the invention, there is provided an apparatus for displaying a grayscale of a plasma display panel, which divides an externally input image signal into frames and divides each frame into a plurality of subfields allocated a predetermined brightness value. The apparatus includes an image signal detection unit, which detects frequency of each grayscale, which indicates the number of cells to be displayed for each grayscale, in a frame of the image signal; an image characteristic determination unit, which determines an image characteristic necessary for grayscale display using the frequency of each grayscale detected by the image signal detection unit; a subfield setting unit, which sets the number of grayscales in the frame and the number of subfields in the frame according to the image characteristic determined by the image characteristic determination unit; and a subfield generation unit, which forms data for each subfield such that an image can be displayed at a brightness level corresponding to a setup by the subfield setting unit, and allocates a brightness level to each subfield.

In various embodiments of the invention, the subfield setting unit includes a grayscale number setter, which sets the number of grayscales in the frame, and a subfield number setter, which sets the number of subfields in the frame.

According to still another aspect of the invention, there is provided an apparatus for displaying a grayscale of a plasma display panel, which divides an externally input image signal into frames and divides each frame into a plurality of subfields allocated a predetermined brightness value. The apparatus includes an image signal detection unit including an average signal level detector, which detects an average signal level of the image signal in a frame, and a frequency-of-grayscale detector, which detects frequency of each grayscale, which indicates the number of cells to be displayed for each grayscale, in the frame; an image characteristic determination unit, which determines an image characteristic necessary for grayscale display according to the average signal level and the frequency of each grayscale; a subfield setting unit, which sets the number of grayscales in the frame and the number of subfields in the frame according to the image characteristic determined by the image characteristic determination unit; and a subfield generation unit, which forms data for each subfield such that an image can be displayed at a brightness level corresponding to a setup by the subfield setting unit, and allocates a brightness level to each subfield.

In various embodiments of the invention, the image signal detection unit may operate the frequency-of-grayscale detector only when the average signal detected by the average signal level detector is lower than a predetermined reference level.

In various embodiments of the invention, the subfield setting unit may include a sustain pulse number setter, which sets the number of sustain pulses in the frame; a grayscale number setter, which sets the number of grayscales in the frame; and a subfield number setter, which sets the number of subfields in the frame.

According to the invention, low grayscales are smoothly displayed, brightness is increased, or generation of pseudo-contours can be suppressed according to the characteristics of an image to be displayed so that an optimal image corresponding with visibility can be displayed.

BRIEF DESCRIPTION OF THE DRAWINGS

The above and other features and advantages of the invention will become more apparent by describing in detail preferred embodiments thereof with reference to the attached drawings.

DETAILED DESCRIPTION OF THE INVENTION

Hereinafter, exemplary embodiments of the invention will be described in detail with reference to the attached drawings.

Figure 11:
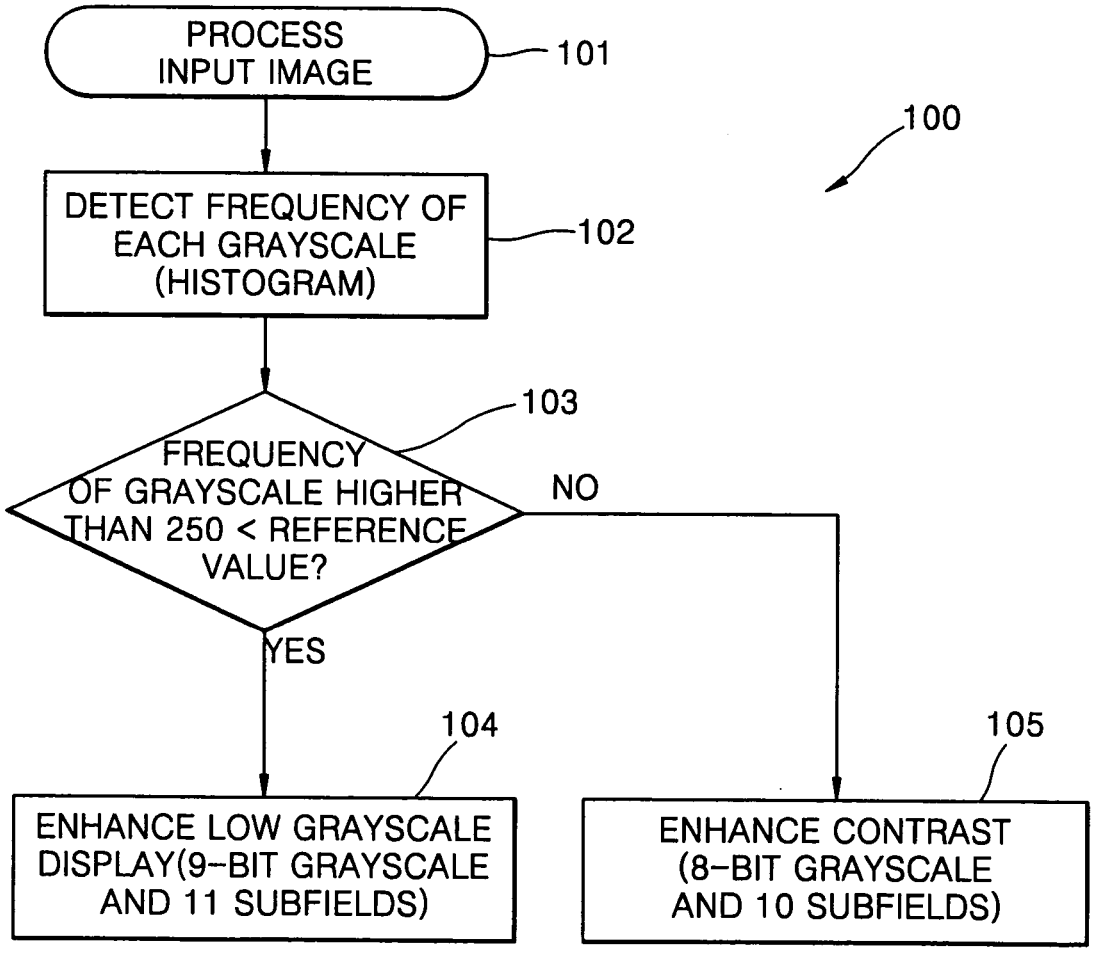
FIG. 11 is a schematic flowchart of a method of displaying a grayscale of a plasma display panel according to an embodiment of the invention.
Figure 12A:
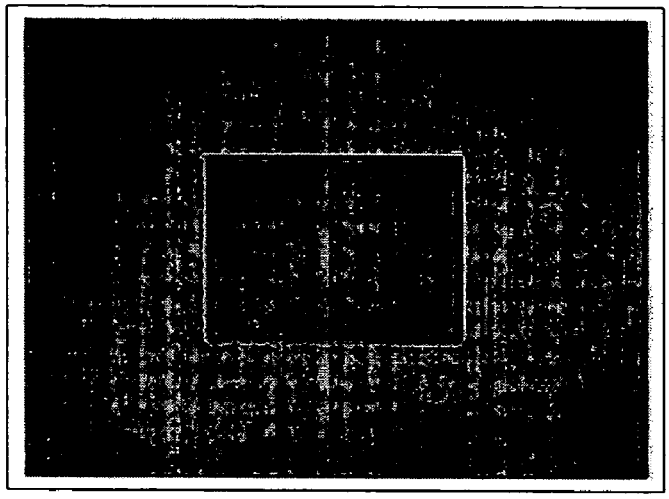
FIG. 12A is a picture of the state of an image when frequency of each grayscale is concentrated on a grayscale area having a low brightness value.
Figure 12B:
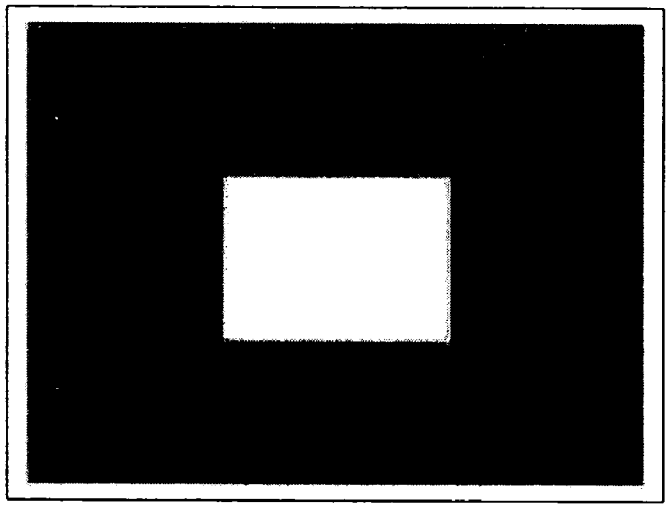
FIG. 12B is a picture of the state of an image when frequency of each grayscale is separately distributed in a grayscale area having a low brightness value and a grayscale area having a high brightness value.
Figure 13A:
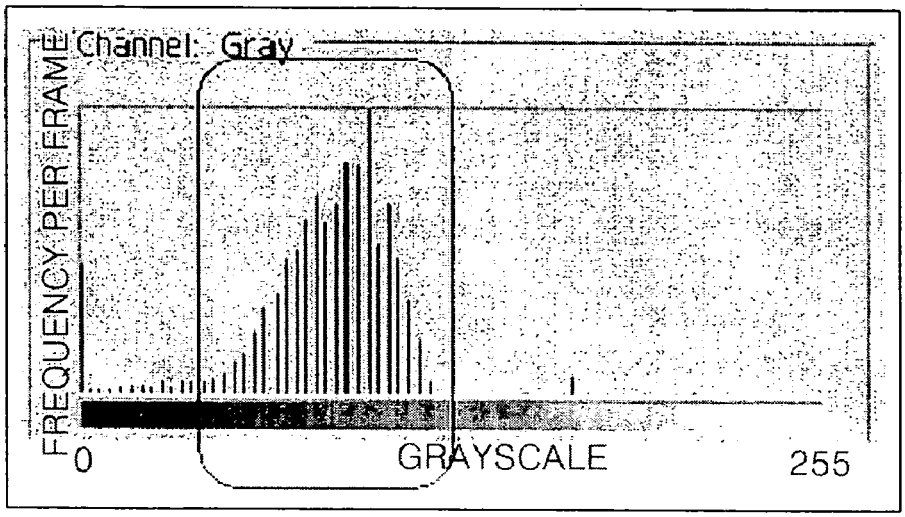
FIG. 13A is a schematic histogram corresponding to FIG. 12A.
Figure 13B:
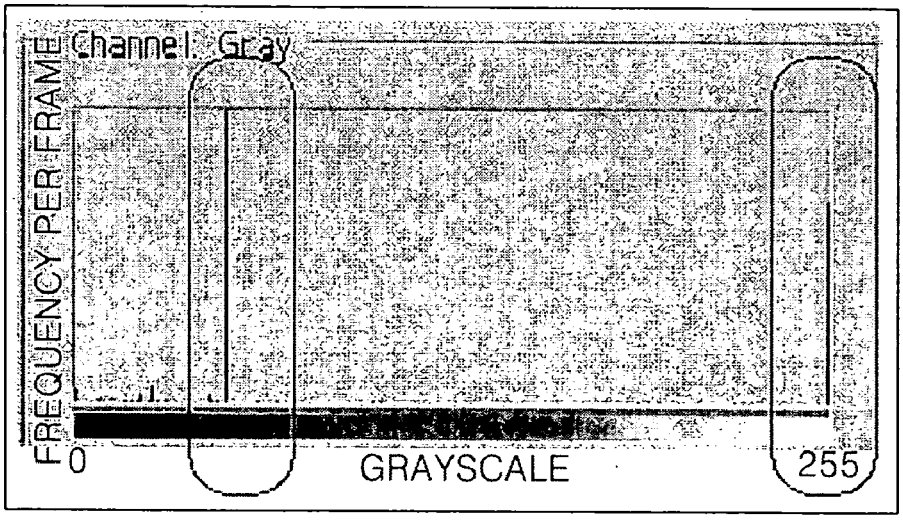
FIG. 13B is a schematic histogram corresponding to FIG. 12B.

FIG. 11 is a schematic flowchart of a method for displaying a grayscale of a plasma display panel according to an exemplary embodiment of the invention. FIG. 12A is a picture of the state of an image when the frequency of each grayscale is concentrated on a grayscale area having a low brightness value. FIG. 12B is a picture of the state of an image when the frequency of each grayscale is distributed in both a grayscale area having a low brightness value and a grayscale area having a high brightness value. FIG. 13A is a schematic histogram corresponding to FIG. 12A, and FIG. 13B is a schematic histogram corresponding to FIG. 12B.

Referring to FIG. 11, in the method of displaying a grayscale of a plasma display panel (100), an externally input image signal is processed to be divided into frames (Step 101). To display grayscales, a frame is divided into a plurality of subfields to each of which a predetermined brightness value is set. Then, the frequency of each grayscale, which indicates the number of cells to be displayed for each grayscale in the frame is detected (102). Grayscales are displayed by adjusting at least one among the number of grayscales in the frame and the number of subfields in the frame according to the frequency of each grayscale (Steps 104 and 105).

The method 100 may include detecting frequency of each grayscale (102), comparing the frequency (Step 103), and setting subfields (Steps 104 and 105). In step 102, the frequency of each grayscale displayed in a frame is detected. In step 103, the sum of the frequencies of grayscales higher than a reference grayscale is compared with a predetermined reference value. In steps 104 and 105, the subfields are set by adjusting at least one among the number of grayscales in the frame and the number of subfields in the frame according to the result of comparison.

In a method of displaying a grayscale of a plasma display panel according to the invention, subfields are set by adjusting at least one among the number of grayscales per frame and the number of subfields per frame according to the characteristics of grayscales to be displayed so that the grayscales can be optimally displayed. To determine the grayscale characteristics of a frame, the frequency of each grayscale to be displayed in the frame is detected. The frequency of each grayscale can be detected from a histogram, composed of frequency of each grayscale according to a brightness value, shown in FIG. 13A or 13B.

In the exemplary embodiment of the invention, in the default setting, a grayscale is displayed using 8 bits in a frame, and the frame is composed of 11 subfields. Since 8 bits are used for grayscale display in a frame, 256 grayscales from a grayscale having a brightness value of 0 to a grayscale having a brightness value of 255 sequentially appear on the horizontal axis of each of the histograms shown in FIGS. 13A and 13B. Frequency of each grayscale in a frame appears on the vertical axis of each histogram.

In the exemplary embodiment of the invention, the grayscale characteristics are divided into a first case and a second case, as respectively shown in FIGS. 13A and 13B. In the first case, as shown in FIG. 13A, the frequencies of grayscales are concentrated on a grayscale area having low brightness values. In the second case, as shown in FIG. 13B, the frequencies of grayscales are separately distributed in a grayscale area having a low brightness value and a grayscale area having a high brightness value.

FIG. 13A is the histogram expressing an image having the grayscale distribution shown in FIG. 12A, in which grayscales having low brightness values are widely spread in the image. To optimally display such an image to correspond with visibility, it is preferable to subdividingly display the grayscales having the low brightness values.

FIG. 13B is the histogram expressing an image having the grayscale distribution shown in FIG. 12B, in which a grayscale having a low brightness value and a grayscale having a high brightness value form peaks and are separated from each other. To optimally display such an image to correspond with visibility, it is preferable to appropriately express brightness and contrast because it is essential to an image quality to ensure contrast based on the expression of brightness.

In the exemplary embodiment of the invention, a detection frequency, i.e., the sum of the frequencies of grayscales having a brightness value higher than a reference brightness value, is detected in step 102. The reference brightness value may be set to, for example, 250 when 256 grayscales having brightness values from 0 to 255 are displayed. The detection frequency is detected from the histogram shown in FIG. 13A or 13B by adding inputs of data higher than a particular brightness value. Accordingly, an operation speed for calculation of the detection frequency is increased, and a burden of additional hardware can be reduced.

In step 103, when the detection frequency is less than the predetermined reference value, the current frame is classified into the first case. When it is not, the current frame is classified into the second case.

When the frame is classified into the first case, the number of grayscales and the number of subfields in the frame are increased in order to enhance an ability to display grayscales-having low brightness values in step 104. In order to enhance the ability to display grayscales having low brightness values, 9 bits can be used for grayscale display, and 11 subfields can be set in the frame.

When the frame is classified into the second case, the number of subfields in the frame is decreased in order to enhance contrast in step 105. In order to enhance brightness and contrast, 8 bits can be used for grayscale display, and 10 subfields can be set in the frame.

Human eyes can easily feel a difference in brightness of low grayscales in an area in which low grayscales frequently appear. However, they cannot easily recognize a difference in brightness of an image which is bright as a whole. When low grayscales are continued in an image, that is, when an input image is roughly dark, excellent visibility can be accomplished by making a difference between grayscales change smoothly and continuously.

Accordingly, in the invention, when an image having grayscales biased to low levels is displayed, as shown in FIGS. 12A and 13A, a subfield corresponding to predetermined brightness can be added to subdividingly display a low grayscale area. The additional subfield may have the half of the brightness of a subfield corresponding to the least significant bit (LSB).

When the frequency of data having high brightness exceeds a predetermined value, even if an input image is dark because it has a low average signal level (ASL), it is preferable to enhance a contrast factor. To enhance the contrast factor, a subfield corresponding to predetermined brightness is removed, and 8 bits are used for grayscale display. The removed subfield may have the half of the brightness of a subfield corresponding to the LSB. In this situation, it is possible to increase the number of sustain pulses in a subfield to increase the brightness of an image.

According to the invention, an optimal image can be displayed to correspond to visibility by smoothing the low grayscale display or increasing the brightness and contrast in accordance with the characteristics of an image to be displayed.

Figure 14:
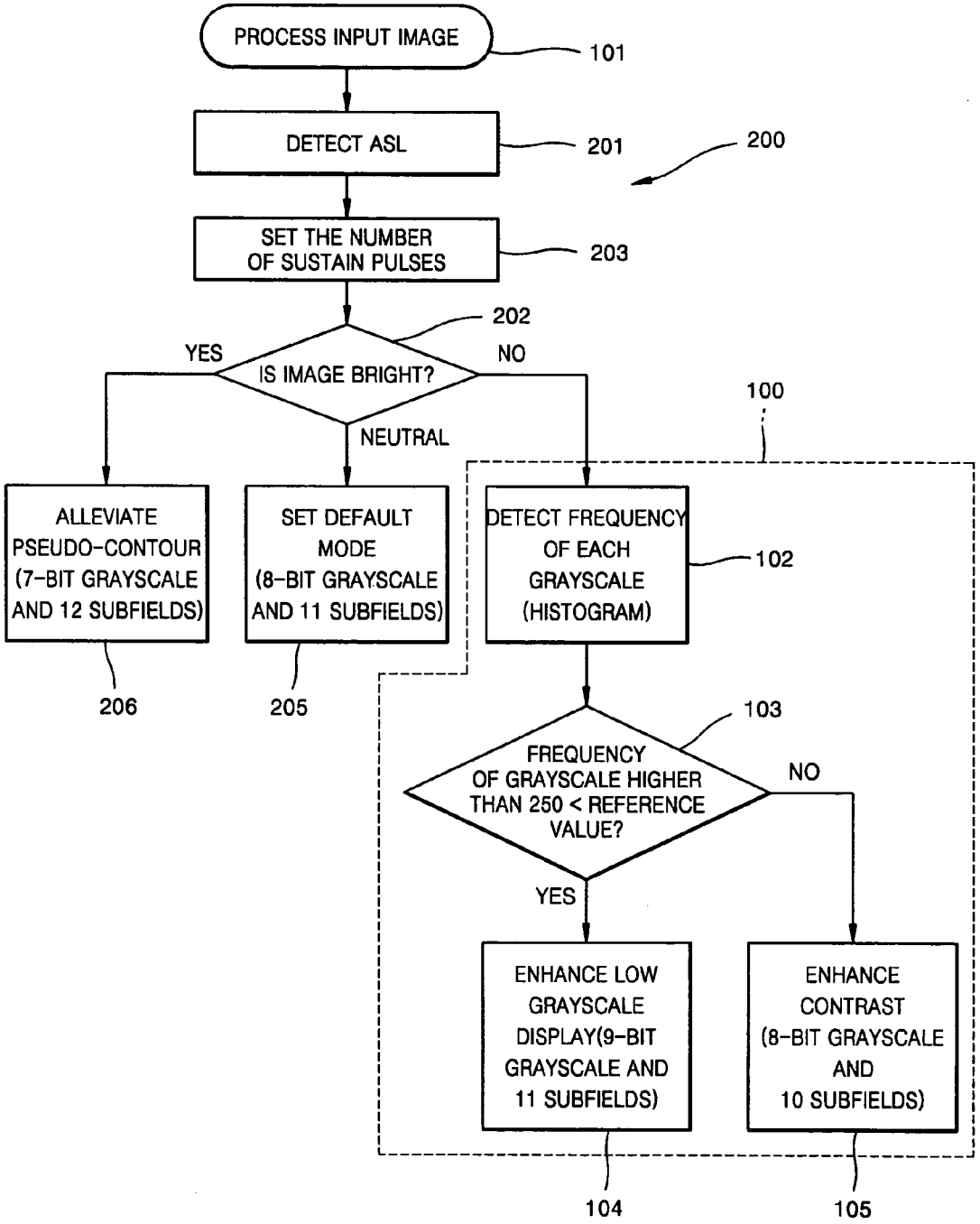
FIG. 14 is a schematic flowchart of a method of displaying a grayscale of a plasma display panel according to another embodiment of the invention.

FIG. 14 is a schematic flowchart of a method of displaying a grayscale of a plasma display panel according to another exemplary embodiment of the invention. In FIGS. 11 and 14, the same reference numerals denote the same element, and a detailed description thereof will be omitted.

In the method of displaying a grayscale of a plasma display panel (200) according the exemplary embodiment of the invention, an externally input image signal is processed to be divided into frames (Step 101). In order to display grayscales in each frame divided into a plurality of subfields to each of which a predetermined brightness value is set, the frequency of each grayscale, which indicates the number of cells to be displayed for each grayscale in the frame, is detected (Step 102). Grayscales are displayed by adjusting at least one among the number of grayscales in the frame and the number of subfields in the frame according to the frequency of each grayscale (Steps 104, 105, 205, and 206).

The method 200 includes detecting a signal level (Step 201), comparing the signal level (202), detecting frequency of each grayscale (Step 102), comparing the frequency (Step 103), and setting subfields (Steps 104, 105, 205, and 206).

In step 201, an ASL of the input image signal in a frame is detected. In step 202, the ASL is compared with a predetermined reference level. In step 102, the frequency of each grayscale displayed in the frame is detected. In step 103, the sum of the frequencies of grayscales higher than a reference grayscale, i.e., the detection frequency, is compared with a predetermined reference value. In steps 104, 105, 205, and 206, the subfields are set by adjusting at least one among the number of grayscales in the frame and the number of subfields in the frame according to the result of comparing the ASL and the result of comparing the detected frequency.

It is possible to control the consumption power to be lower than a predetermined level during an operation of a plasma display panel. For this control, in the embodiment of the invention, an ASL is predicted with respect to each frame, and the number of sustain pulses is controlled according to the ASL. It is possible that the ASL is an average brightness level of each discharge cell, which is obtained by dividing the sum of brightness values of all discharge cells in an input image signal of a frame by the number of all discharge cells of the plasma display panel.

Formula (1) shows an ASL obtained from average brightness data of each discharge cell. In formula 1, V denotes a single frame having a vertical sync frequency of 60 Hz and N denotes the number of discharge cells each including red (R), green (G), and blue (B) cells. $RData_n$, $GData_n$, and $BData_n$ denote brightness data values, respectively, in R, G, and B cells, respectively.

$$ASL = \left(\sum_V RData_n + \sum_V GData_n + \sum_V BData_n\right) / 3N \quad \text{(formula 1)}$$

It is possible for the method 200 to further include adjusting a discharge time (Step 203). In step 201, the discharge time is adjusted by controlling the number of sustain discharges in the frame to be in inverse proportion to the ASL.

Figure 1:
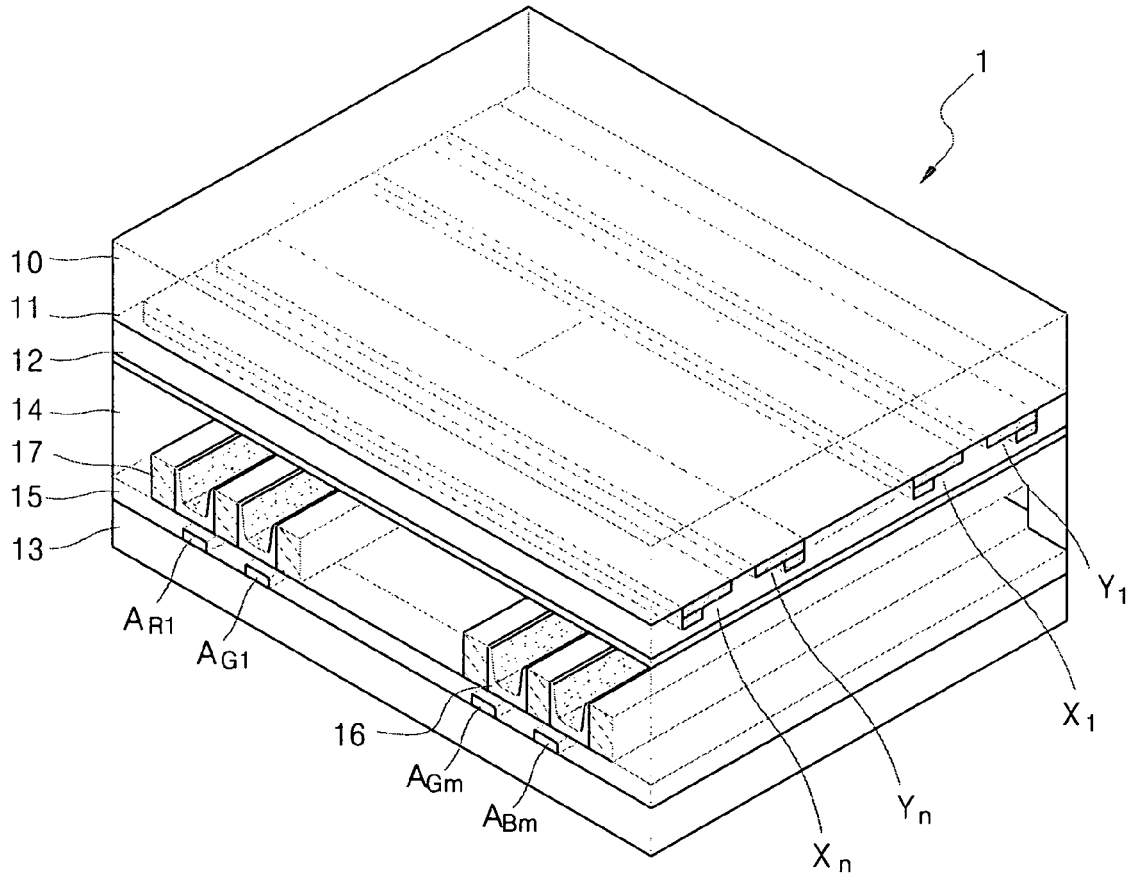
FIG. 1 (PRIOR ART)
FIG. 1 is a perspective view of the internal structure of a typical surface discharge type triode plasma display panel.
Figure 2:
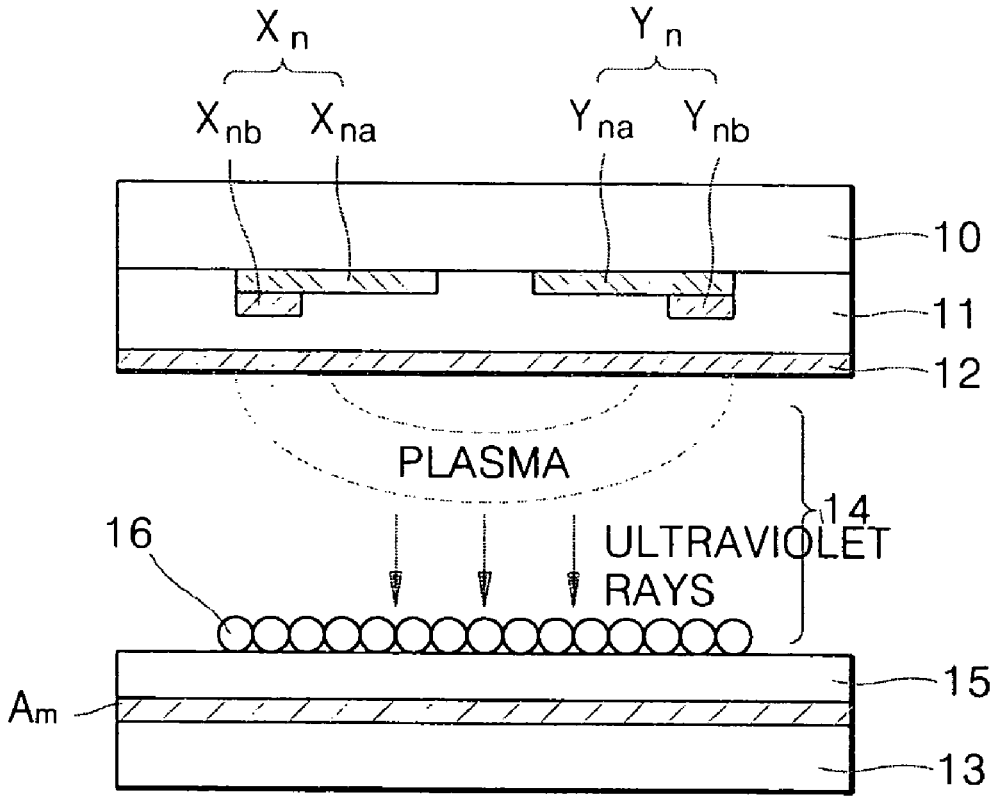
FIG. 2 (PRIOR ART)
FIG. 2 is a sectional view of an example of a discharge cell in the plasma display panel shown in FIG. 1.
Figure 3:
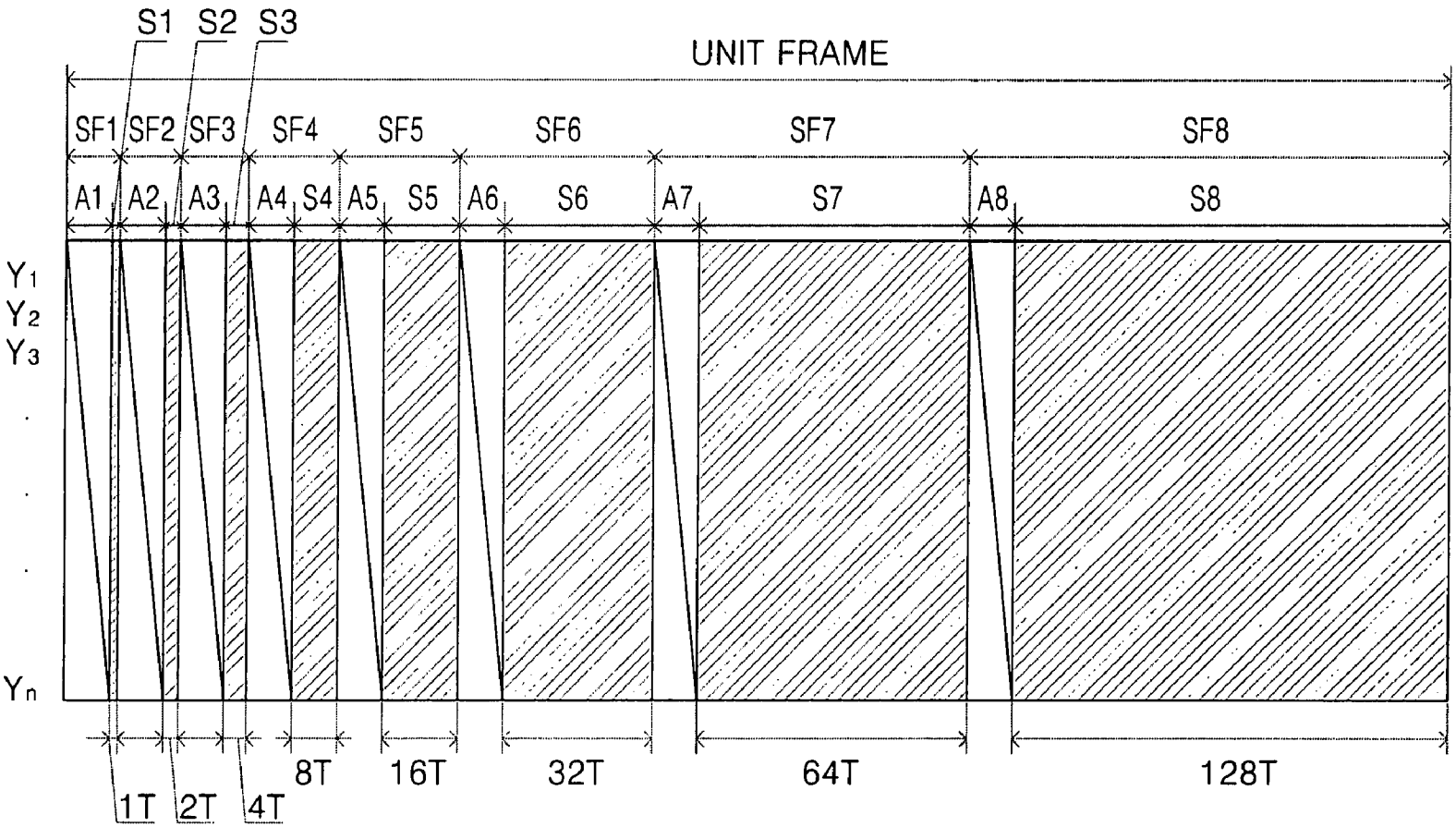
FIG. 3 (PRIOR ART)
FIG. 3 is a timing diagram of a typical address-display separation driving method with respect to Y-electrode lines of the plasma display panel shown in FIG. 1.
Figure 4:
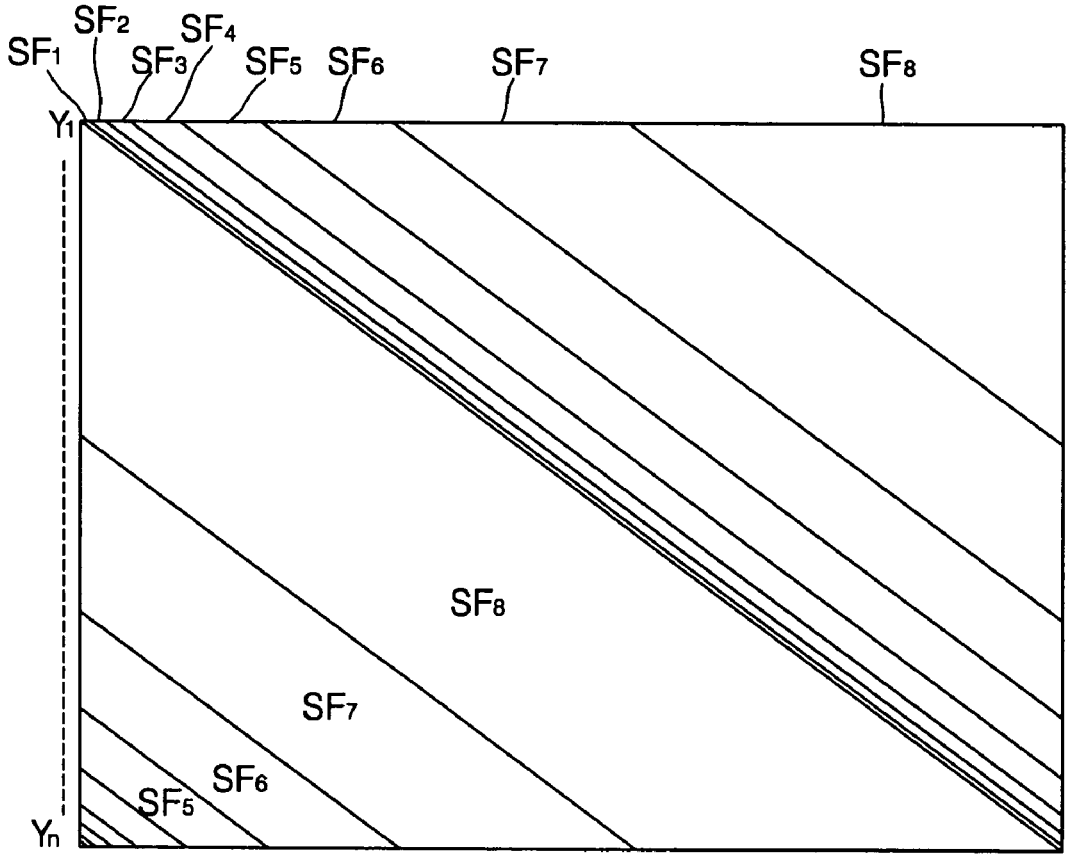
FIG. 4 (PRIOR ART)
FIG. 4 is a timing diagram of a typical address-while-display driving method with respect to Y-electrode lines of the plasma display panel shown in FIG. 1.
Figure 5:
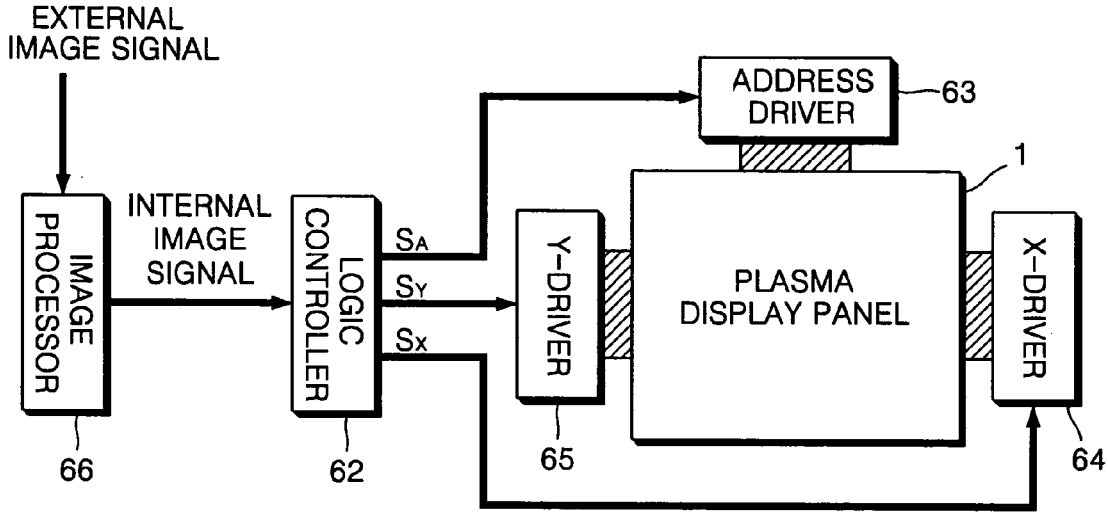
FIG. 5 (PRIOR ART)
FIG. 5 is a block diagram of a typical driving apparatus for the plasma display panel shown in FIG. 1.
Figure 6:
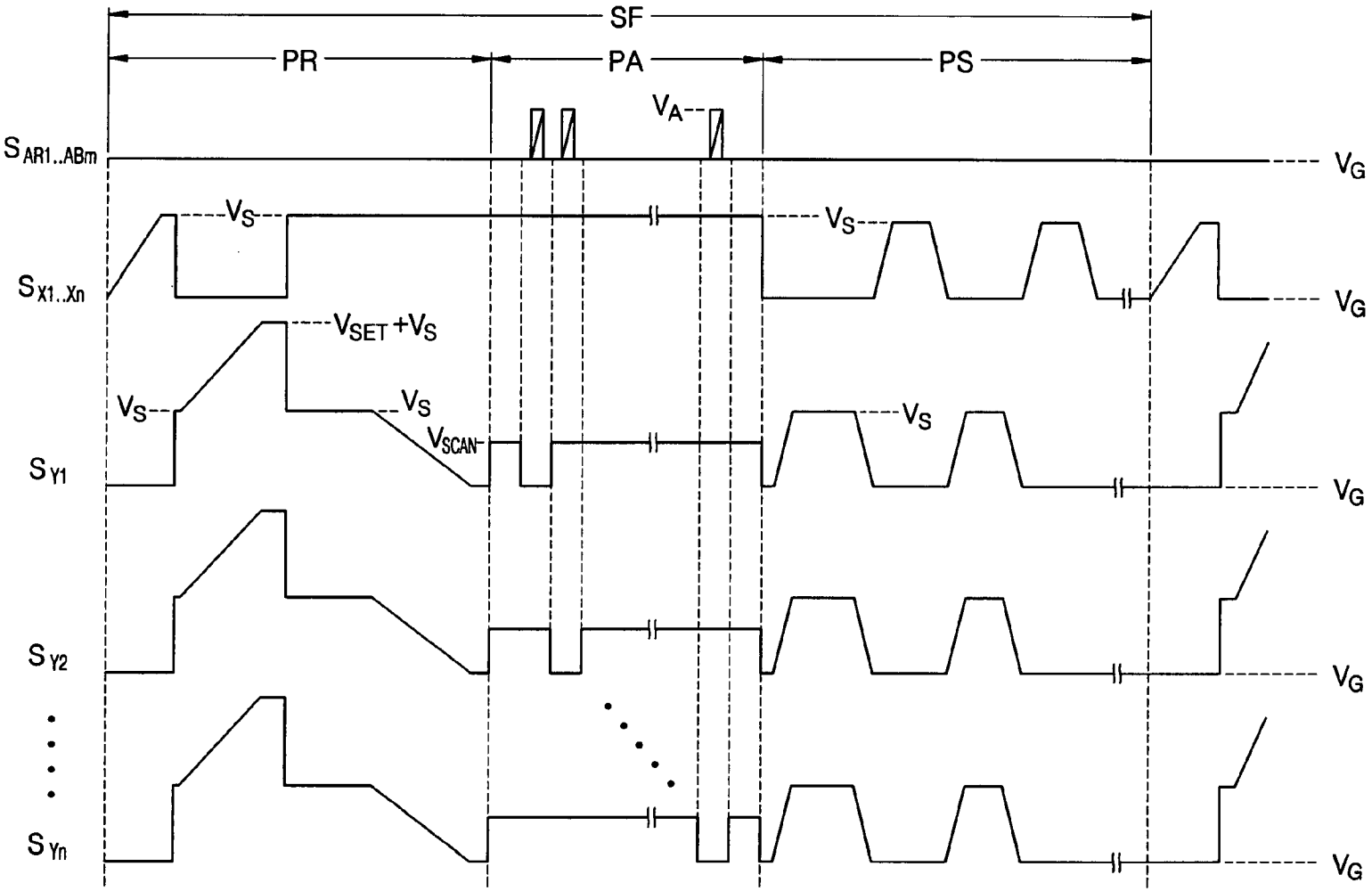
FIG. 6 (PRIOR ART)
FIG. 6 is a timing chart of driving signals applied to the plasma display panel shown in FIG. 1 in a unit subfield according to the address-display separation driving method shown in FIG. 3.
Figure 7:
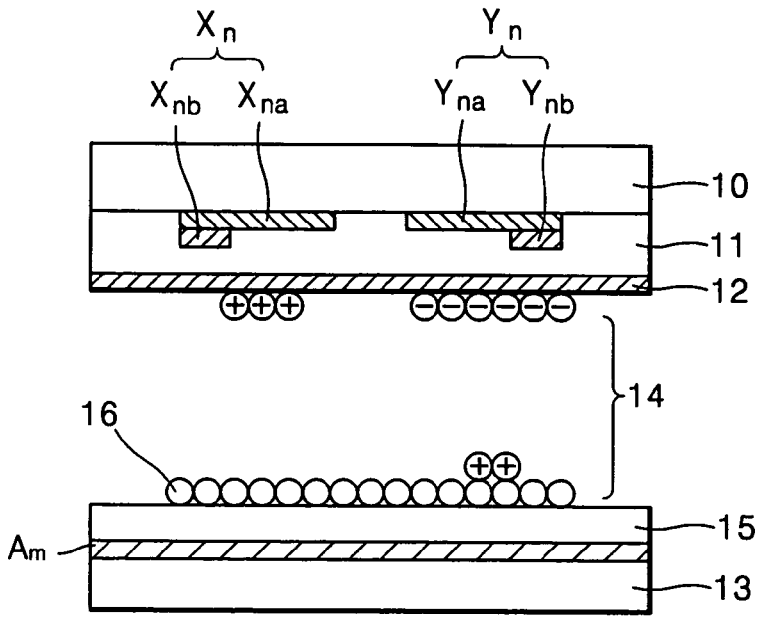
FIG. 7 (PRIOR ART)
FIG. 7 is a cross-section showing a distribution of wall charges in a discharge cell immediately after a gradually increasing voltage is applied to Y-electrode lines during a reset period of FIG. 6.
Figure 8:
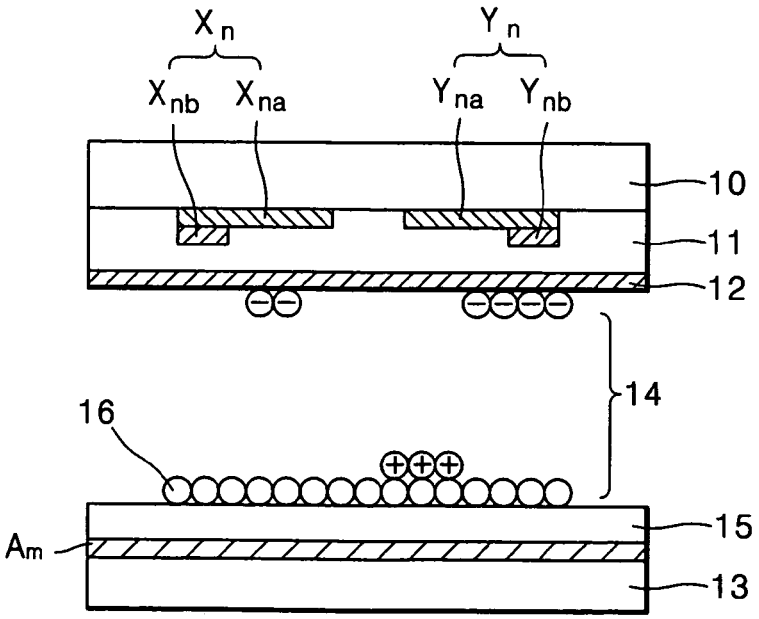
FIG. 8 (PRIOR ART)
FIG. 8 is a cross-section showing a distribution of wall charges in a discharge cell at an end point of the reset period of FIG. 6.
Figure 9:
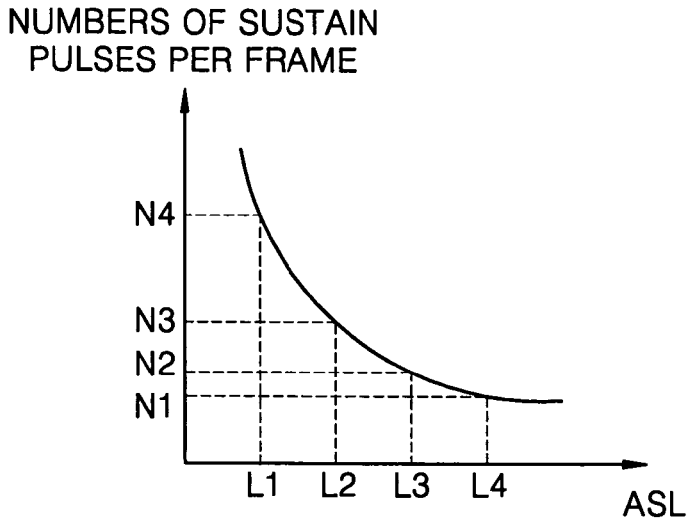
FIG. 9 (PRIOR ART)
FIG. 9 is a graph showing a principle of automatic power control (APC) according to an average signal level (ASL) in a typical plasma display panel.
Figure 10:
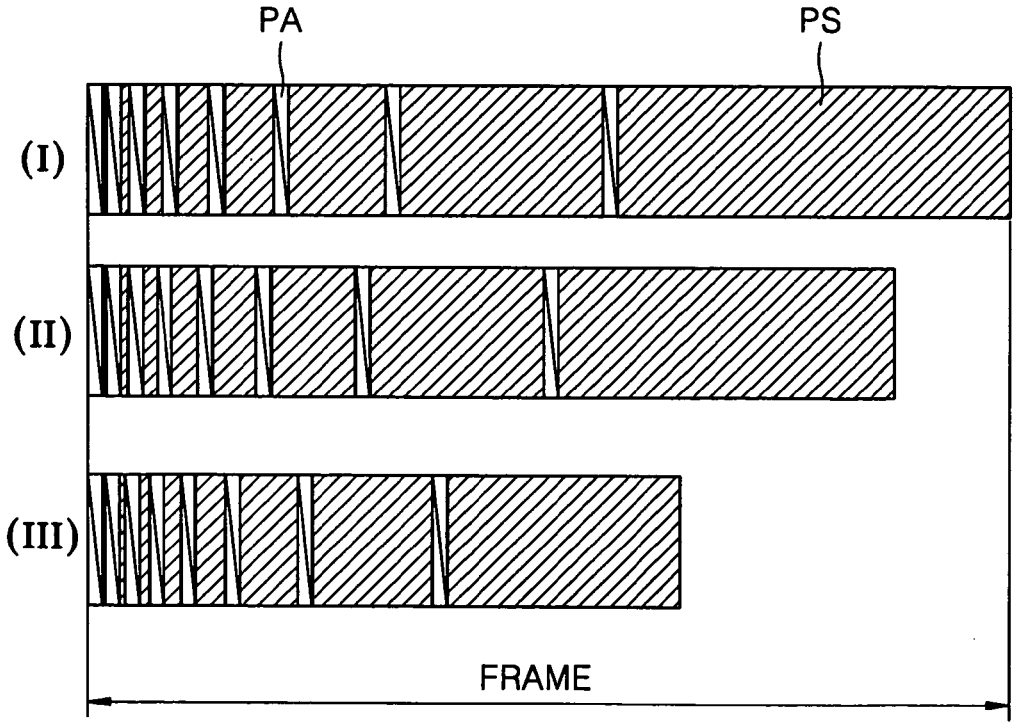
FIG. 10 (PRIOR ART)
FIG. 10 schematically illustrates a typical method of displaying a grayscale of a plasma display panel using APC according to an ASL.

According to the invention, images having different characteristics can be optimally displayed in correspondence with visibility. In addition, automatic power control (APC) is performed using the method illustrated in FIGS. 9 and 10 in step 203 so that the same number of sustain pulses is applied, thereby maintaining power consumption constant.

In steps 104, 105, 205, and 206, display of grayscales can be controlled according to an image characteristic determined in step 202 and a grayscale characteristic determined in step 103.

In step 104, low grayscale display is enhanced by increasing the number of grayscales and the number of subfields in the frame to smoothly express a difference between low grayscales. In step 105, contrast is enhanced by decreasing the number of subfields in the frame. Decrease in brightness that occurs when the frame includes many subfields can be prevented so that brightness and contrast can be expressed appropriately.

In step 206, a pseudo-contour is alleviated by decreasing the number of grayscales in the frame. In step 205, a default mode is set so that the number of grayscales and the number of subfields in the frame are set to default values, respectively.

In step 202, the image characteristic is determined using a first reference level and a second reference level. Here, the brightness of an image can be determined according to the ASL. When the ASL is higher than the first reference level, a pseudo-contour is alleviated in step 206. When the ASL is lower than the first reference level and higher than the second reference level, the default mode is set in step 205. When the ASL is lower than the second reference level, the frequency of each grayscale is detected in step 102.

In step 206, a pseudo-contour in a motion picture is alleviated by decreasing the number of grayscales in the frame. When the ASL is high, an entire image is bright. Accordingly, it is preferable to reduce a difference in brightness between subfields by decreasing the number of grayscales so as to decrease a pseudo-contour, instead of enhancing low grayscale display.

When necessary, a pseudo-contour can be decreased by weighting duplicacy of a subfield based on the frequency of each grayscale in the frame, without increasing brightness.

In the invention, under the default condition that 8 bits are used for grayscale display and a single frame is composed of 11 fields, input image frames are classified into four characteristics based on input image information so that images can be optimally displayed according to the characteristics so as to correspond with visibility. In other words, the characteristic of an image frame is determined based on the ASL of the image frame and frequency of each grayscale in the image frame, and one among operations of alleviating a pseudo-contour, setting a default mode, enhancing low grayscale display, and enhancing contrast is performed, so that an optimal image can be displayed according to the image characteristic.

Figure 15:
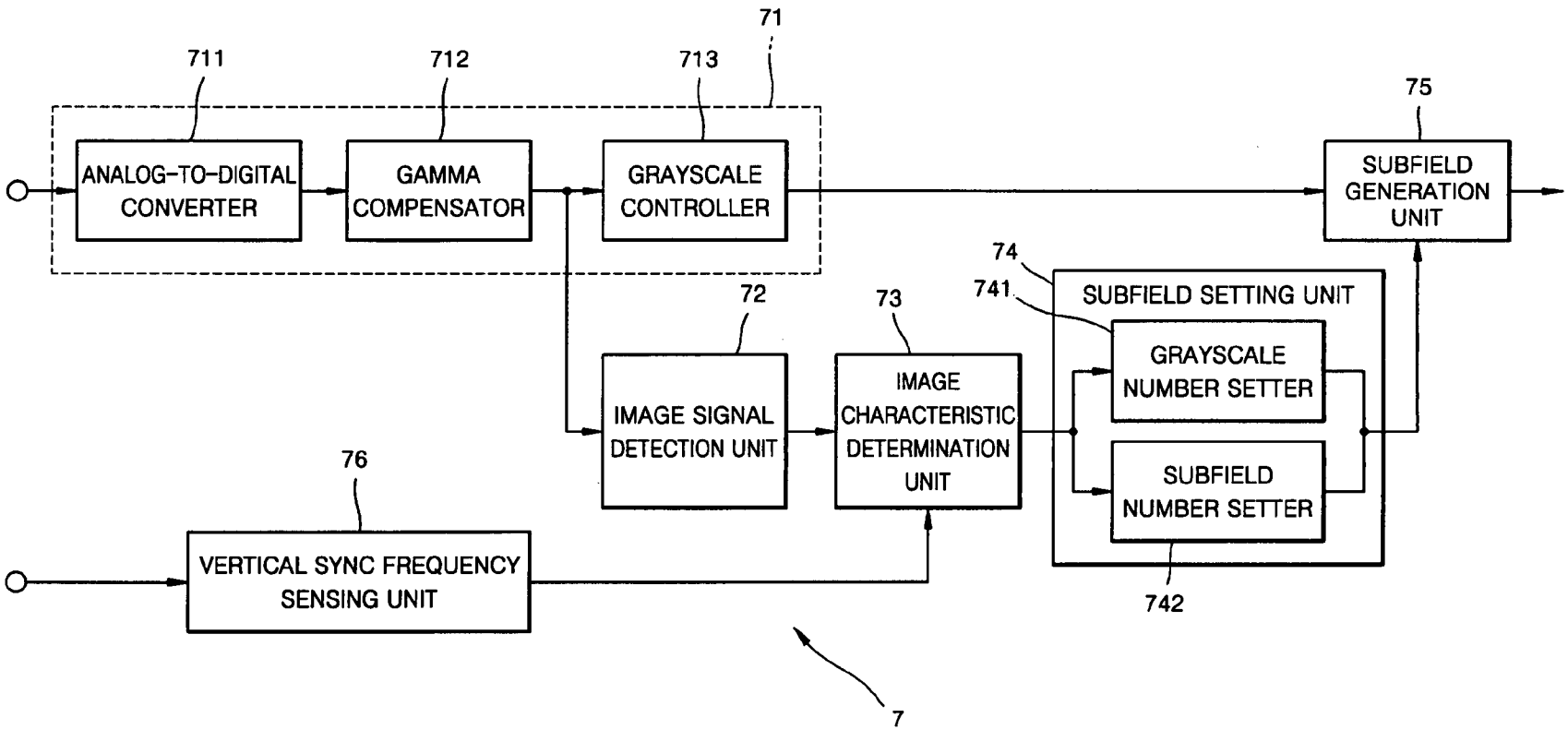
FIG. 15 is a block diagram of an apparatus for displaying a grayscale of a plasma display panel according to an embodiment of the present invention.

FIG. 15 is a block diagram of an apparatus for displaying a grayscale of a plasma display panel according to an embodiment of the present invention. Referring to FIG. 15, the apparatus 7 includes a signal processing unit 71, an image signal detection unit 72, an image characteristic determination unit 73, a subfield setting unit 74, and a subfield generation unit 75. The apparatus 7 uses the method 100 shown in FIG. 11.

The image signal detection unit 72 detects the frequency of each grayscale in an input image signal of each frame. The image characteristic determination unit 73 determines an image characteristic necessary for grayscale display using the frequency of each grayscale. The subfield setting unit 74 sets the number of grayscales and the number of subfields for a current frame according to the image characteristic determined by the image characteristic determination unit 73. The subfield generation unit 75 forms data for each subfield such that an image can be displayed at a brightness level corresponding to the setup by the subfield setting unit 74 and allocates a brightness level to each subfield.

The subfield setting unit 74 includes a grayscale number setter 741 and a subfield number setter 742. The grayscale number setter 741 sets the number of grayscales for each frame. The subfield number setter 742 sets the number of subfields for each frame.

The image signal detection unit 72 detects a detection frequency, i.e., the sum of frequencies of grayscales having a brightness value higher than a reference brightness value. When the detection frequency is less than a predetermined reference value, the subfield setting unit 74 increases the number of grayscales and the number of subfields in the current frame. When the detection frequency is equal to or higher than the predetermined reference value, the subfield setting unit 74 decreases the number of subfields in the current frame.

The signal processing unit 71 performs a series of signal processing steps such as digital conversion, gamma compensation, and error diffusion. The signal processing unit 71 includes an analog-to-digital converter 711, a gamma compensator 712, and a grayscale controller 713.

The analog-to-digital converter 711 converts an externally input image signal from an analog format into a digital format. The image signal input to the gamma compensator 712 has a reverse nonlinear input/output characteristic to compensate for a nonlinear input/output characteristic of a cathode-ray tube. Accordingly, the gamma compensator 712 processes the image signal having the reverse nonlinear input/output characteristic to have a linear input/output characteristic. The grayscale controller 713 controls display of grayscales, for example, performs error diffusion so that a grayscale using more than 8 bits can be displayed.

A vertical sync frequency sensing unit 76 senses a vertical frequency of an input image signal and outputs the vertical frequency to the image characteristic determination unit 73. The vertical frequency may be 60 Hz in the National Television Systems Committee (NTSC) standard and 50 Hz in the Phase Alternate Line (PAL) standard. Usually, plasma display panels can drive both vertical frequencies of 60 Hz and 50 Hz. The vertical sync frequency sensing unit 76 senses the vertical frequency and allows a driving apparatus of a plasma display panel to operate according to the characteristic of the sensed vertical frequency.

According to the invention, low grayscales are smoothly displayed or brightness is increased according to the characteristics of an image to be displayed so that an optimal image corresponding with visibility can be displayed.

Figure 16:
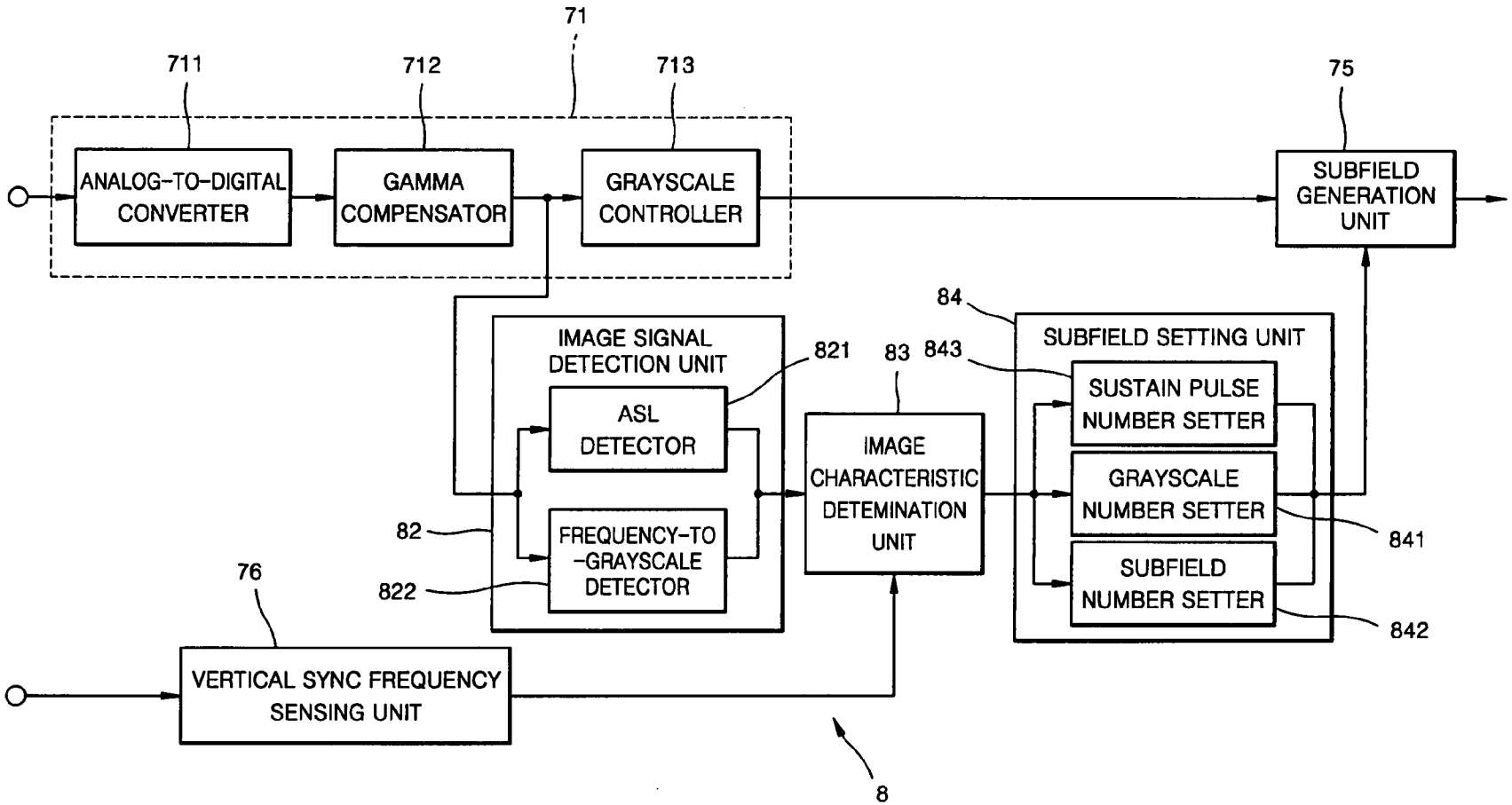
FIG. 16 is a block diagram of an apparatus for displaying a grayscale of a plasma display panel according to another embodiment of the invention.
Figure 17:
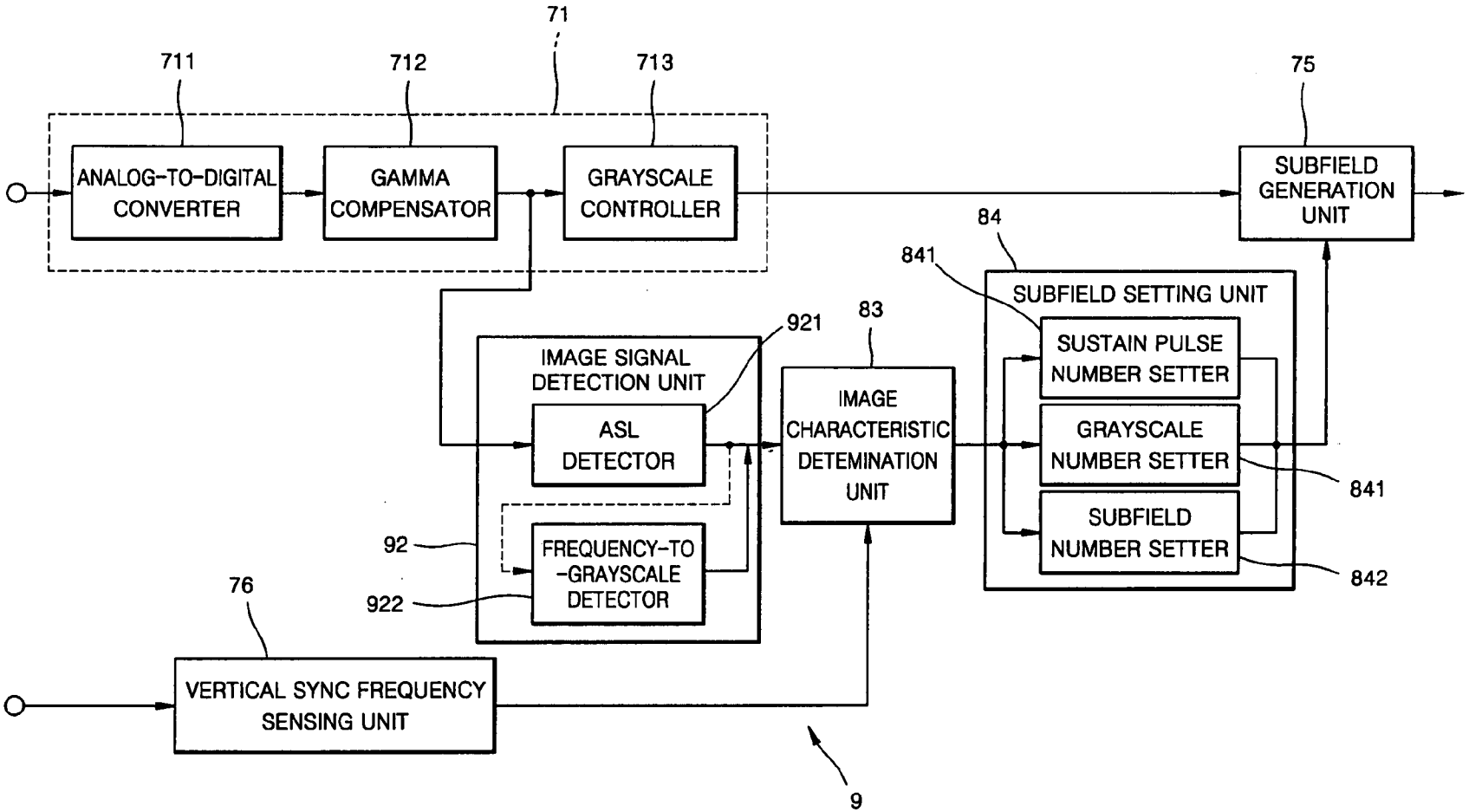
FIG. 17 is a block diagram of an apparatus for displaying a grayscale of a plasma display panel according to still another embodiment of the invention.

FIG. 16 is a block diagram of an apparatus for displaying a grayscale of a plasma display panel according to another exemplary embodiment of the invention. FIG. 17 is a block diagram of an apparatus for displaying a grayscale of a plasma display panel according to still another exemplary embodiment of the invention. Apparatuses 8 and 9 shown in FIGS. 16 and 17, respectively, use the method shown in FIG. 14 and have the same effects, and thus a detailed description of the method will be omitted. In FIGS. 15 through 17, the same reference numerals denote the same member, and a detailed description thereof will be omitted.

The apparatus 8 and 9 divide externally input image signal into frames and divides each frame into a plurality of subfields allocated a predetermined brightness value to display grayscales. The apparatus 8 and 9 detect the frequency of each grayscale, i.e., the number of cells to be displayed for each grayscale, in a frame and adjusts at least one among the number of grayscales and the number of subfields in the frame according to the frequency of each grayscale to display grayscales. Each of the apparatuses 8 and 9 includes the signal processing unit 71, an image signal detection unit 82 or 92, an image characteristic determination unit 83, a subfield setting unit 84, and the subfield generation unit 75.

The image signal detection unit 82 includes an ASL detector 821 detecting an ASL of the image signal and a frequency-of-grayscale detector 822 detecting frequency of each grayscale displayed in the frame. The image signal detection unit 92 includes an ASL detector 921 and a frequency-of-grayscale detector 922, which have the same functions as the ASL detector 821 and the frequency-of-grayscale detector 822. However, in the image signal detection unit 92, the frequency-of-grayscale detector 922 operates only when an ASL detected by the ASL detector 921 is less than a predetermined reference level.

The image characteristic determination unit 83 determines an image characteristic necessary for grayscale display according to the ASL detected by the image signal detection unit 82 or 92 and the frequency of each grayscale. The subfield setting unit 84 sets the number of grayscales and the number of subfields in the frame according to the image characteristic determined by the image characteristic determination unit 83. The subfield generation unit 75 forms data for each subfield such that an image can be displayed at a brightness level corresponding to the setup by the subfield setting unit 84 and allocates a brightness level to each subfield.

The subfield setting unit 84 includes a sustain pulse number setter 843 setting the number of sustain pulses for the frame, a grayscale number setter 841 setting the number of grayscales in the frame, and a subfield number setter 842 setting the number of subfields in the frame.

The frequency-of-grayscale detectors 822 and 922 detect a detection frequency, i.e., the sum of frequencies of grayscales having a brightness value greater than a predetermined reference brightness value.

The subfield setting unit 84 increases the number of grayscales and the number of subfields in the frame when the detection frequency detected by the frequency-of-grayscale detector 822 or 922 is less than a predetermined reference value and decreases the number of subfields in the frame when the detection frequency detected by the frequency-of-grayscale detector 822 or 922 is equal to or greater than the predetermined reference value.

When the ASL is higher than a predetermined reference level, the subfield setting unit 84 decreases the number of grayscales in the frame to decrease brightness difference between subfields in the frame so that generation of pseudo-contours in a motion picture is alleviated.

According to the invention, low grayscales are smoothly displayed, brightness is increased, or generation of pseudo-contours can be suppressed according to the characteristics of an image to be displayed so that an optimal image corresponding with visibility can be displayed.

As described above, according to the invention, an optimal image corresponding with visibility can be displayed by smoothing low grayscale display or increasing brightness according to the characteristic of an image to be displayed.

Although a few embodiments of the invention have been shown and described, it will be appreciated by those skilled in the art that changes may be made in these elements without departing from the principles and spirit of the invention, the scope of which is defined in the appended claims and their equivalents.

What is claimed is:

1. A method for displaying a grayscale of a plasma display panel, by which an externally input image signal is divided into frames and each frame is divided into a plurality of subfields allocated a predetermined brightness value, the method comprising:

(a) detecting a frequency of each grayscale, where the frequency indicates the number of cells to be displayed for each grayscale in a frame;

(b) comparing the frequency of each grayscale with a predetermined reference value; and (c) adjusting at least one among the number of grayscales in the frame and the number of subfields in the frame according to a result of the comparison to set subfields in the frame.

2. The method of claim 1, wherein step (c) comprises enhancing low grayscale display by increasing at least one among the number of grayscales in the frame and the number of subfields in the frame and enhancing contrast by decreasing the number of subfields in the frame.

3. The method of claim 2, wherein step (a) comprises detecting a detection frequency which is a sum of frequencies of grayscales higher than a predetermined reference grayscale, and the low grayscale display is enhanced in step (c) when the detection frequency is less than the predetermined reference value.

4. The method of claim 3, wherein when the detection frequency is equal to or greater than the predetermined reference value, the contrast is enhanced in step (c).

5. The method of claim 4, wherein when 256 grayscales are displayed in each frame, the predetermined reference grayscale is 250.

6. A method of displaying a grayscale of a plasma display panel, by which an externally input image signal is divided into frames and each frame is divided into a plurality of subfields allocated a predetermined brightness value, the method comprising:

(a) detecting an average signal level of the image signal in a frame;

(b) comparing the detected average signal level with a predetermined reference level;

(c) detecting a frequency of each grayscale which indicates the number of cells to be displayed for each grayscale in the frame;

(d) comparing the frequency of each grayscale with a predetermined reference value; and (e) adjusting at least one among the number of grayscales in the frame and the number of subfields in the frame according to the result of comparing the average signal level and a result of comparing the sum of the frequencies to set subfields in the frame.

7. The method of claim 6, further comprising adjusting a discharge time to be in inverse proportion to the average signal level.

8. The method of claim 6, wherein step (e) comprises:

enhancing low grayscale display by increasing at least one among the number of grayscales in the frame and the number of subfields in the frame;

enhancing contrast by decreasing the number of subfields in the frame, alleviating a pseudo-contour by decreasing the number of grayscales in the frame; and setting a default mode by setting the number of grayscales in the frame and the number of subfields in the frame to predetermined default values, respectively.

9. The method of claim 8, wherein when the average signal level is higher than a first predetermined reference level, the pseudo-contour is alleviated in step (e).

10. The method of claim 9, wherein when the average signal level is lower than the first predetermined reference level and higher than a second predetermined reference level, the default mode is set in step (e).

11. The method of claim 10, wherein when the average signal level is lower than the second predetermined reference level, step (c) is performed.

12. The method of claim 11, wherein step (c) comprises detecting a detection frequency which is the sum of frequencies of grayscales higher than a predetermined reference grayscale, and the low grayscale display is enhanced in step (e) when the detection frequency is less than the predetermined reference value.

13. The method of claim 12, wherein when the detection frequency is equal to or greater than the predetermined reference value, the contrast is enhanced in step (e).

14. The method of claim 12, wherein when 256 grayscales are displayed in each frame, the predetermined reference grayscale is 250.

15. An apparatus for displaying a grayscale of a plasma display panel, which divides an externally input image signal into frames and divides each frame into a plurality of subfields allocated a predetermined brightness value, the apparatus comprising:

an image signal detection unit, which detects a frequency of each grayscale, where the frequency indicates the number of cells to be displayed for each grayscale, in a frame of the image signal;

an image characteristic determination unit, which determines an image characteristic necessary for grayscale display using the frequency of each grayscale detected by the image signal detection unit;

a subfield setting unit, which sets the number of grayscales in the frame and the number of subfields in the frame according to the image characteristic determined by the image characteristic determination unit; and a subfield generation unit, which forms data for each subfield such that an image can be displayed at a brightness level corresponding to a setup by the subfield setting unit, and allocates a brightness level to each subfield.

16. The apparatus of claim 15, wherein the subfield setting unit comprises a grayscale number setter, which sets the number of grayscales in the frame, and a subfield number setter, which sets the number of subfields in the frame.

17. The apparatus of claim 15, wherein the image signal detection unit detects a detection frequency which is the sum of frequencies of grayscales higher than a predetermined reference grayscale, and the subfield setting unit increases the number of grayscales in the frame and the number of subfields in the frame when the detection frequency is less than a predetermined reference value and decreases the number of subfields in the frame when the detection frequency is equal to or greater than the predetermined reference value.

18. An apparatus for displaying a grayscale of a plasma display panel, which divides an externally input image signal into frames and divides each frame into a plurality of subfields allocated a predetermined brightness value, the apparatus comprising:

an image signal detection unit comprising an average signal level detector, which detects an average signal level of the image signal in a frame, and a frequency-of-grayscale detector, which detects a frequency of each grayscale, which indicates the number of cells to be displayed for each grayscale, in the frame;

an image characteristic determination unit, which determines an image characteristic necessary for grayscale display according to the average signal level and the frequency of each grayscale;

a subfield setting unit, which sets the number of grayscales in the frame and the number of subfields in the frame according to the image characteristic determined by the image characteristic determination unit; and a subfield generation unit, which forms data for each subfield such that an image can be displayed at a brightness level corresponding to a setup by the subfield setting unit, and allocates a brightness level to each subfield.

19. The apparatus of claim 18, wherein the image signal detection unit operates the frequency-of-grayscale detector only when the average signal detected by the average signal level detector is lower than a predetermined reference level.

20. The apparatus of claim 18, wherein the subfield setting unit comprises:

a sustain pulse number setter, which sets the number of sustain pulses in the frame;

a grayscale number setter, which sets the number of grayscales in the frame; and a subfield number setter, which sets the number of subfields in the frame.

21. The apparatus of claim 18, wherein the frequency-of-grayscale detector detects a detection frequency which is the sum of frequencies of grayscales higher than a predetermined reference grayscale, and the subfield setting unit increases the number of grayscales in the frame and the number of subfields in the frame when the detection frequency is less than a predetermined reference value and decreases the number of subfields in the frame when the detection frequency is equal to or greater than the predetermined reference value.

22. The apparatus of claim 18, wherein when the average signal level is higher than a predetermined reference level, the subfield setting unit decreases the number of grayscales in the frame to decrease brightness difference between subfields in the frame so that generation of pseudo-contours in a motion picture is suppressed.

* * * * *